US005123344A

United States Patent [19]

Mödder

[11] Patent Number: 5,123,344

[45] Date of Patent: Jun. 23, 1992

[54] APPLICATION DEVICE FOR MARKING WIRES AND CABLES

[76] Inventor: Manfred Mödder, Zum Fuchsloch 16, D-5628, Heiligenhaus, Fed. Rep. of Germany

[21] Appl. No.: 713,708

[22] Filed: Jun. 11, 1991

[30] Foreign Application Priority Data

Jul. 6, 1990 [DE] Fed. Rep. of Germany ..... 4021543

[51] Int. Cl.[5] ..... B41F 17/10

[52] U.S. Cl. ..... 101/35; 101/27; 101/44

[58] Field of Search ..... 101/35, 27, 41, 42, 101/43, 44

[56] References Cited

U.S. PATENT DOCUMENTS

| | | | |
|---|---|---|---|
| 2,751,841 | 6/1956 | Grupe | 101/44 |
| 3,379,600 | 4/1968 | Schwartz | 101/44 |
| 3,867,882 | 2/1975 | Ahlgren et al. | 101/35 |
| 4,455,935 | 6/1984 | Manz et al. | 101/35 |

FOREIGN PATENT DOCUMENTS

| | | | |
|---|---|---|---|
| 0669607 | 9/1963 | Canada | 101/35 |
| 0135366 | 6/1987 | Japan | 101/35 |
| 0110645 | 11/1917 | United Kingdom | 101/35 |

*Primary Examiner*—Edgar S. Burr
*Assistant Examiner*—Anthony H. Nguyen
*Attorney, Agent, or Firm*—Akoo-Toren

[57] ABSTRACT

An application device for marking wires and cables. The application device includes a foil storage for a printing foil ribbon and a protective foil ribbon. The device also has a printer for imprinting the printing foil ribbon. The printing foil ribbon and the protective foil ribbon which is pressed against the printing foil ribbon after the printing foil ribbon has been imprinted are cut to a marked length in a foil and cutting receiving member and, after the wire to be marked has been sheated with the ribbon to form a closed sleeve, the printing foil ribbon and the protective foil ribbon are welded together.This makes possible a subsequent marking of wire without having to disconnect already connected wires. The marking is protected against ambient influences by the protective foil and can be made at the location where the wire is installed.

18 Claims, 4 Drawing Sheets

Fig. 6
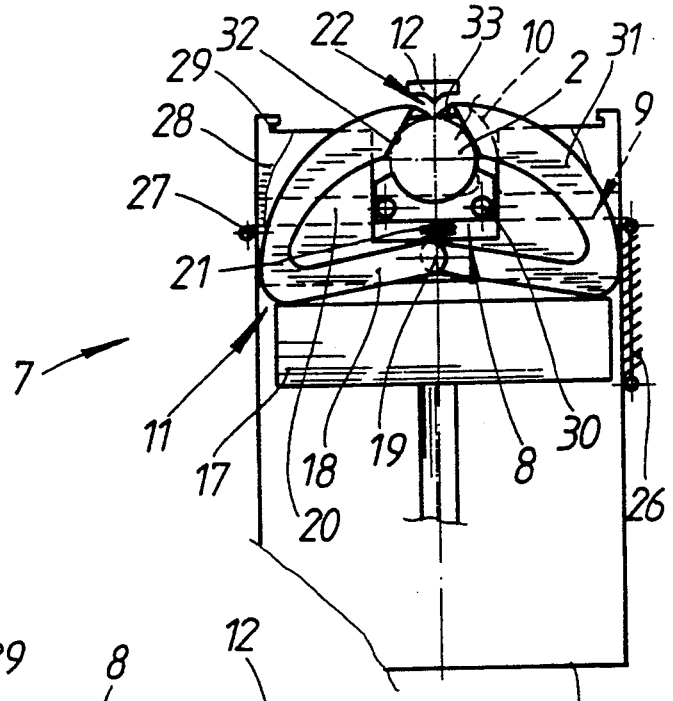
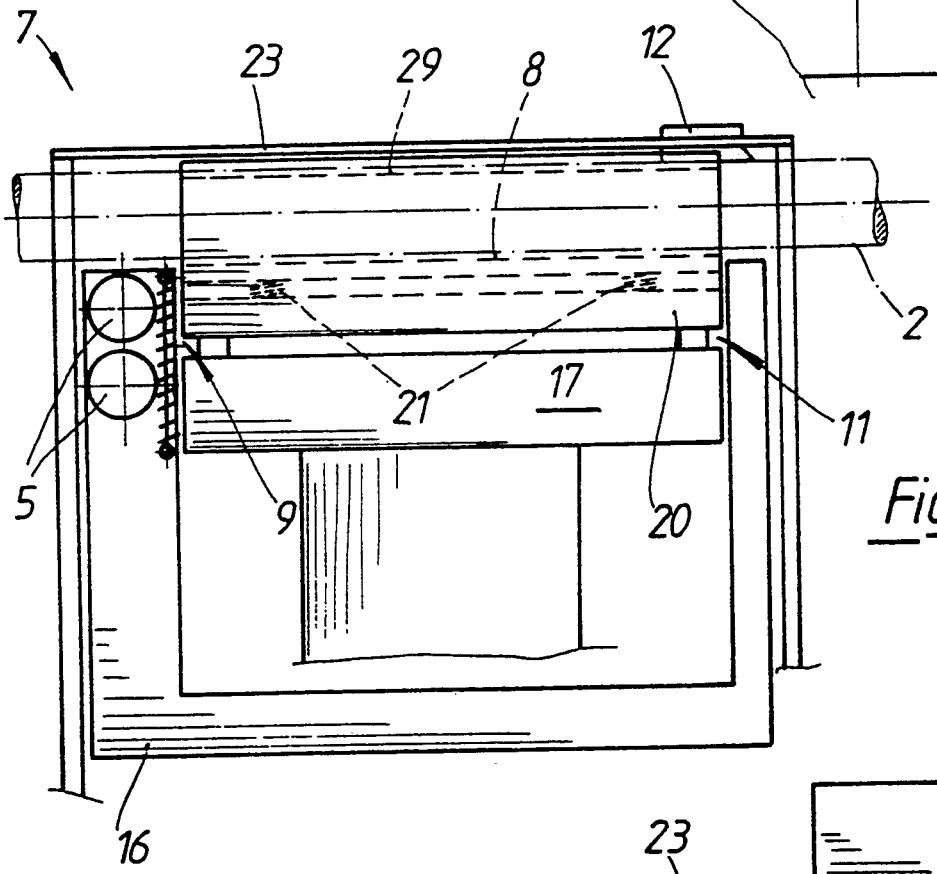
Fig. 7
Fig. 8
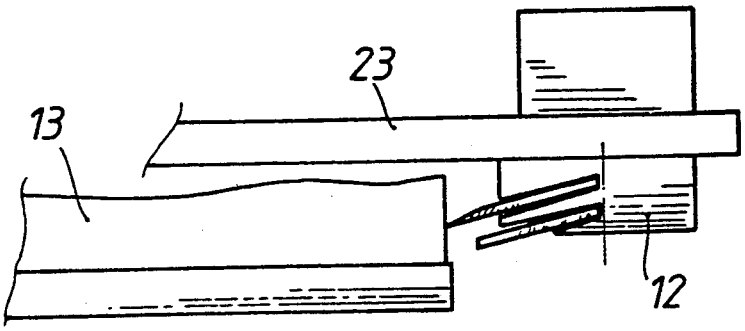

APPLICATION DEVICE FOR MARKING WIRES AND CABLES

BACKGROUND OF THE INVENTION

1. Field of the Invention

The present invention relates to an application device, particularly application gun, for marking wires and cables.

2. Description of the Related Art

It is always difficult to mark wires and cables at the locations where they are to be installed. This is because the marking must be labeled at the location and it must be possible to apply the marking on the respective wire. This labeling at the location may not exclude the receipt of data from a CAD-system and/or another external data file. Moreover, the marking is to be protected against ambient influences and should represent a closed sleeve surrounding the wire. In addition, it must be possible to apply the marking subsequently, i.e., after the wire has been connected, and without having to separate the wire.

SUMMARY OF THE INVENTION

Therefore, it is the object of the present invention to provide an application device, particularly an application gun, which makes possible the marking of wires and cable in a simple and problem-free manner at the location where the wires and cables are to be installed.

In order to meet the above-described objects, the application device or application gun according to the present invention includes the following features:

a foil storage means for a printing foil ribbon and a protective foil ribbon;

transport rollers which are driven in opposite directions by a drive motor for conveying the printing foil ribbon and the protective foil ribbon and for moving and pressing the ribbons together;

a printer with a printing head for imprinting the printing foil ribbon before it is pressed against the protective foil ribbon and with a control means for the printing head;

a work head following the printer, the work head including a wire receiving means for the imprinted printing foil ribbon and the protective foil ribbon pressed against the printing foil ribbon and for the wire to be marked;

a cutting tool for severing an imprinted printing foil and protective foil section between the transport rollers and the foil and wire receiving means;

a wire gripping means for placing the wire to be marked in the foil and wire receiving means and on the printing foil ribbon and protective foil ribbon placed in the foil and wire receiving means;

clamping claws which can be swung in on both sides and transversely to the longitudinal direction of the foil and wire receiving means for completely sheathing the wire with the imprinted printing foil and protective foil section; and a cutting and welding head for cutting the projecting excess length of printing foil ribbon and protective foil ribbon formed after sheathing and for welding the printing foil and protective foil edges which have been cut to the sheathing dimension.

Within the scope of the present invention, printing foil ribbon is a foil ribbon suitable for printing markings thereon. After having been imprinted, the printing foil and protective foil section forms the marking which surrounds the respective wire in the manner of a sleeve after the printing foil and protective foil edges have been welded.

The application device according to the present invention makes it possible to imprint the required markings on the printing foil ribbons at the location where the wire or cable is to be installed, wherein the printing foil ribbon is then covered by a protective foil for protecting the imprinted markings against ambient influences. The printing foil ribbon and the protective foil ribbon which has a greater width are then pressed together and conveyed into the foil and wire receiving ends. Subsequently, the wire to be marked is placed in the foil and wire receiving means. The wire is then sheathed by means of the clamping claws which fold down the initially upwardly extending foil edges, so that the wire is finally completely surrounded by the printing foil ribbon and protective foil ribbon.

In order to form a closed sleeve, the foil ribbons are cut and the foil ribbon edges are welded after the printing foil and protective foil section placed in the foil and wire receiving means had initially been severed from the printing foil ribbon and protective foil ribbon in order to form the actual marking. Consequently, the application device according to the present invention is easily capable of even subsequently marking wires without having to disconnect already connected wires.

In accordance with another important feature of the present invention, the foil storage means may include a roller or cartridge with printing foil ribbon and a roller or cartridge with protective foil ribbon. The transport rollers preferably are needle rollers and are driven by a stepping motor which does not convey the printing foil ribbon when the latter is being imprinted. The printing head may be equipped with a color ribbon.

In accordance with another feature of the invention, the control means for the printing head simultaneously controls the feed of the printing foil ribbon and the protective foil ribbon.

The work head advantageously includes a bearing housing with the cutting tool which is arranged stationary and transversely of the foil conveying direction. The cutting tool may be a knife or an electrically heated cutting wire on which a tensioning spring acts on one side of the housing and which is connected for grounding to the other side of the housing. The printing foil and protective foil sections are severed by a relative movement of the bearing housing to the foil and wire receiving means and, consequently, to the printing foil ribbon and protective foil ribbon. When a heated cutting wire is used, the cutting procedure is simultaneously accompanied by a welding of the respective printing foil and protective foil section.

In accordance with another proposal of the present invention of independent significance, a raisable base plate is mounted in the bearing housing, wherein the clamping claws are supported on the base plate by means of support levers. The support levers are pivotally mounted about a longitudinal axis extending in foil conveying direction and underneath the foil and wire receiving means. The foil and wire receiving means is resiliently elastically supported in a U-shaped bearing bed which is guided in the bearing housing so as to be raisable. The bearing bed includes in a web portion thereof the longitudinal axis for the pivotable support of the clamping claws and is supported so a to be movable relative to the base plate.

When the wire is resting on the web of the U-shaped bearing bed and is held by the wire gripping means, the base plate is successively raised until the clamping claws have swung in and the bearing bed is raisable with the foil and wire receiving means with the application of tensile and compression forces, so that the foil and wire receiving means is pressed against the wire and is pressed downwardly with the wire against the action of a spring until the clamping claws engaging over the wire have completely closed.

As the clamping claws close, they take along the edge portions of the printing foil ribbon and protective foil ribbon, so that when the clamping claws are closed the respective wire is completely sheathed by the printing foil ribbon or section and protective foil ribbon or section. The resilient support of the wire receiving means makes it possible that the wire can yield downwardly when the clamping claws and the sheathing are closed and, thus, makes it also possible to tighten the printing foil and protective foil section surrounding the wire.

In order to prevent a premature pivoting and closing of the clamping claws, it is provided in accordance with the present invention that the foil and wire receiving means has at both end faces thereof rollers for supporting the clamping claws until shortly before the clamping claws reach the closed position. The sides of the U-shaped bearing bed advantageously has lateral guide grooves for the protective foil ribbon resting on the sides of the U-shaped bearing bed.

The wire gripping means may include one or more support rods with hook-like rod ends. The support rods are arranged on both sides of the bearing housing or are structural components of the bearing housing. The foil and wire receiving means is preferably constructed as a support groove and rests with intermediate arrangement of springs on the web of the U-shaped bearing bed.

In accordance with another feature of the invention, the clamping claws include claw stirrups with contact surfaces for the rollers. The claw stirrups are connected to the support levers to form the shape of a V. The clamping claws further include tongue sections which connect the claw stirrups over the length of the foil and wire receiving means. In the closed state, the tongue sections form a V-shaped incision in which the cutting and welding head is moved over the foil edges. Thus, in accordance with the present invention, the cutting and welding head is movable on the bearing housing in longitudinal direction of the foil ribbons above the foil and wire receiving means and is guided on a guide rod. As a result, it is possible in a single work step to cut the projecting excess length of the foil and to weld together the printing foil and protective foil edges which have been cut to sheathing dimensions. Subsequently, the entire work head is returned by means of the force of a spring into the initial position.

The application device according to the present invention is equipped with a computer and data storage and an independent current supply, but can also be connected to mains supply. The device is also capable of receiving data from CAD-systems and from external data files. The data which are made available are sent to the printing head which has its own control means.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 6 is a front view corresponding to FIG. 5, showing the work head after base plate and bearing bed have been raised and the clamping claws have been closed;

FIG. 7 is a side view of the work head of FIG. 6 with the welding and cutting head being moved forward, i.e., after the printing foil and protective foil edges cut to sheathing dimension have been welded; and FIG. 8 is a schematic side view, on a larger scale, of the cutting and welding head.

DESCRIPTION OF THE PREFERRED EMBODIMENT

Figure 1:
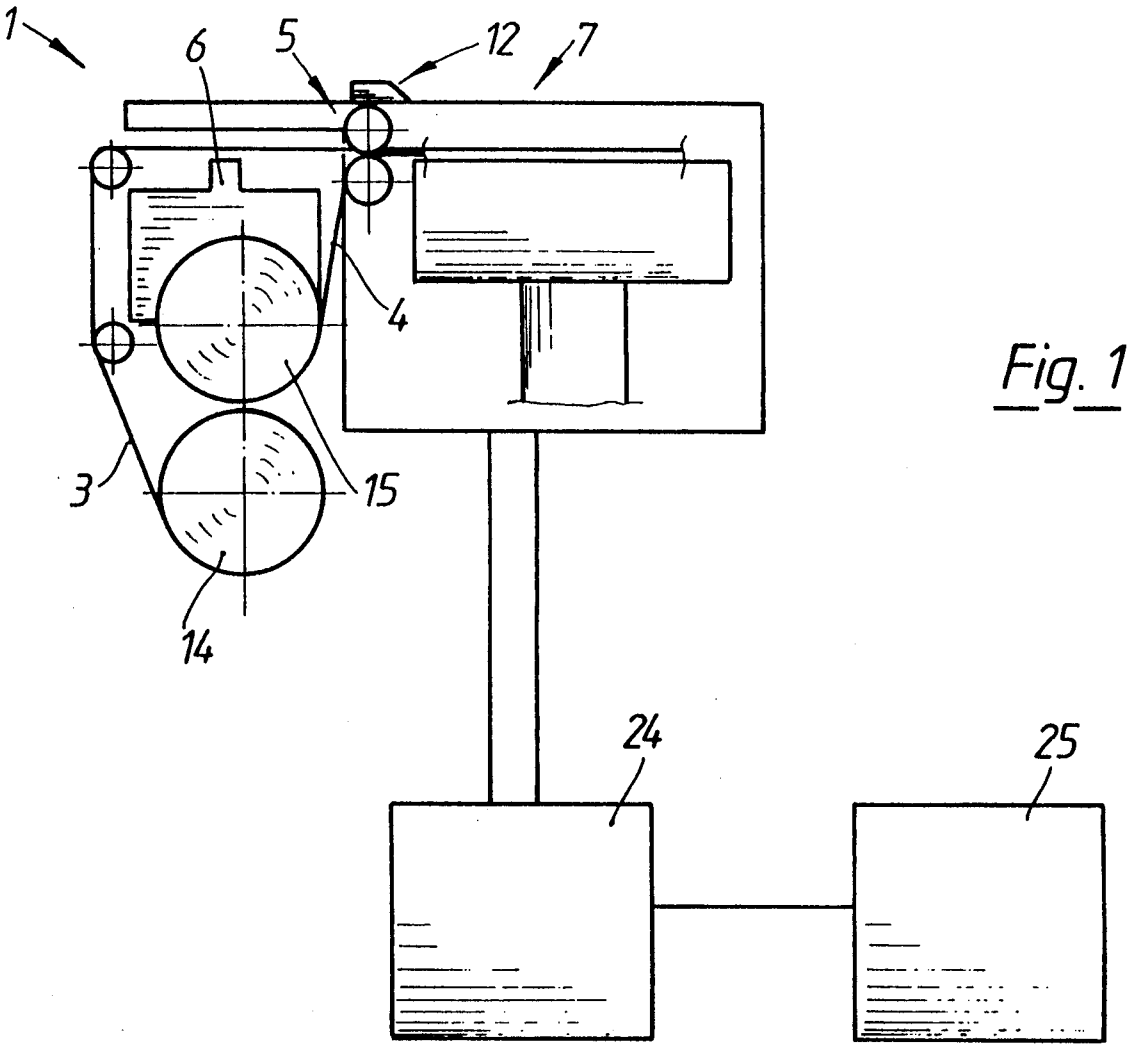
FIG. 1 is a schematic illustration of an application device according to the present invention.

The Figures of the drawing show an application device 1, which may be an application gun, for marking wires 2 and cables. The application device 1 includes a foil storage means for a printing foil ribbon 3 and a protective foil ribbon 4. A drive motor, not shown, is provided for driving transport rollers 5 in opposite directions. The transport rollers 5 convey the printing foil ribbon 3 and the protective foil ribbon 4 and press the protective foil ribbon 4 against the printing foil ribbon 3 after the printing foil ribbon 3 has been imprinted. A printer with a printing head 6 is provided for imprinting the printing foil ribbon 3 before it is pressed against the protective foil ribbon 4. The printer is also provided with a control means, not shown.

Figure 2:
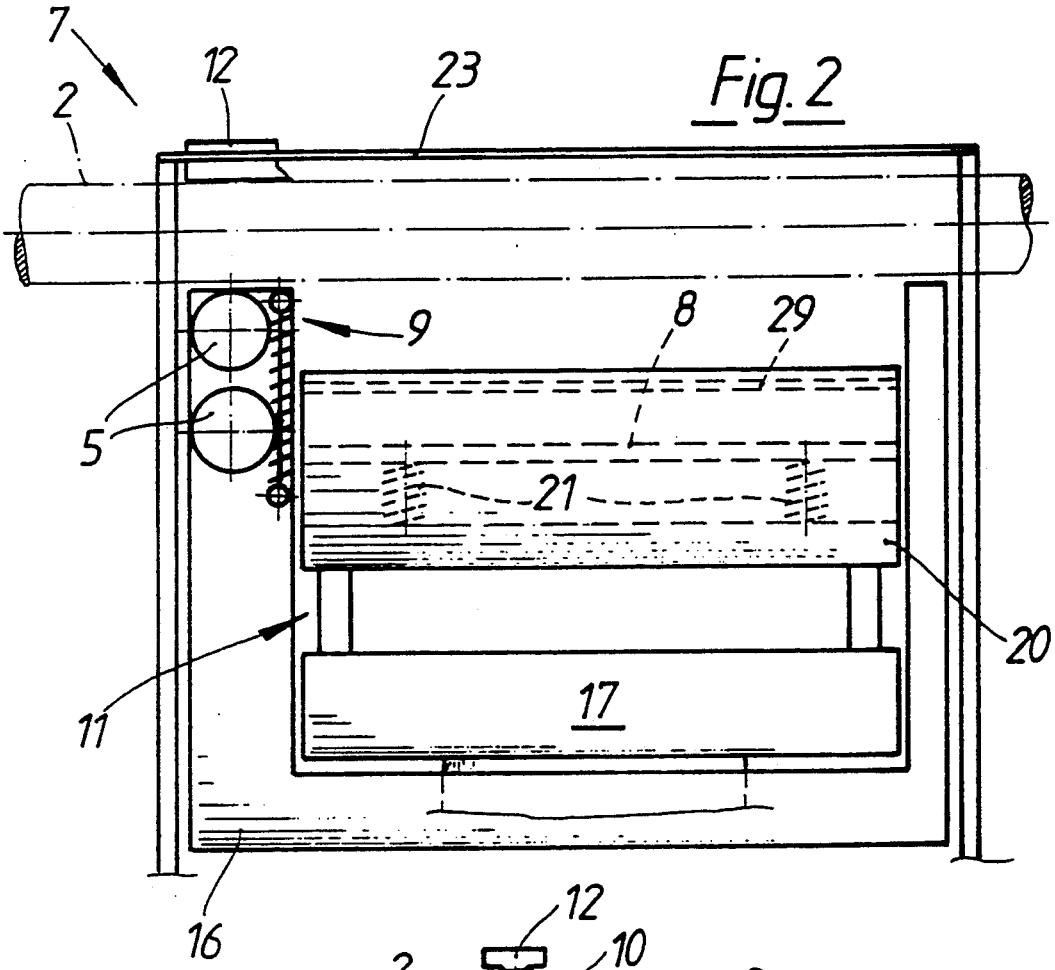
FIG. 2 is a side view, on a larger scale, showing the work head of the device of FIG. 1.
Figure 3:
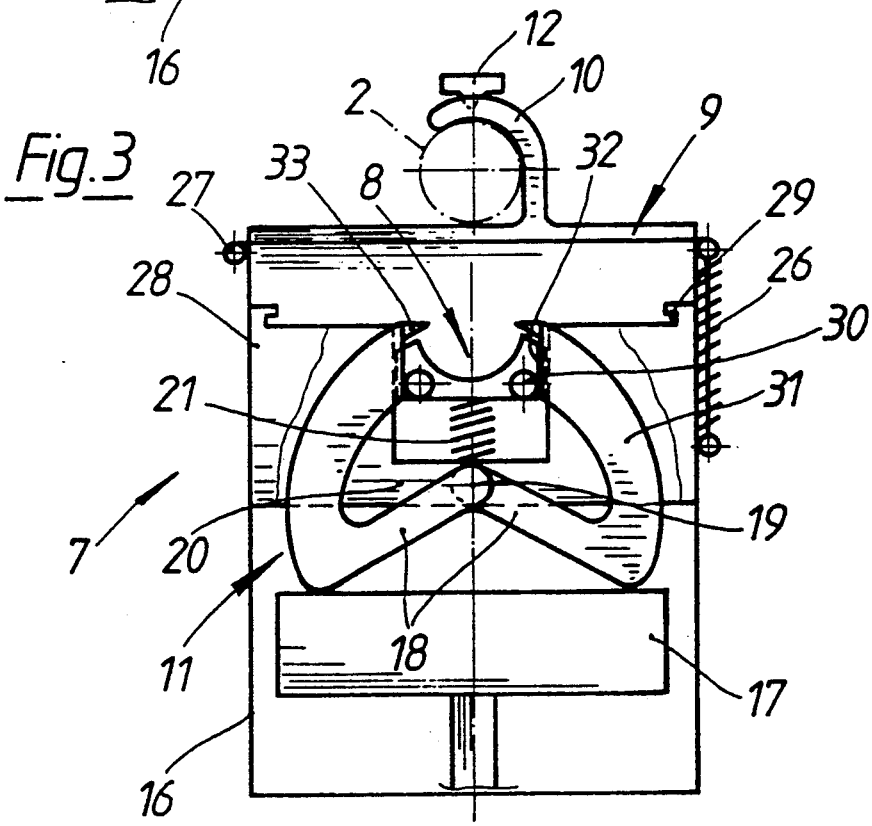
FIG. 3 is a schematic front view of the work head of FIG. 2.
Figure 4:
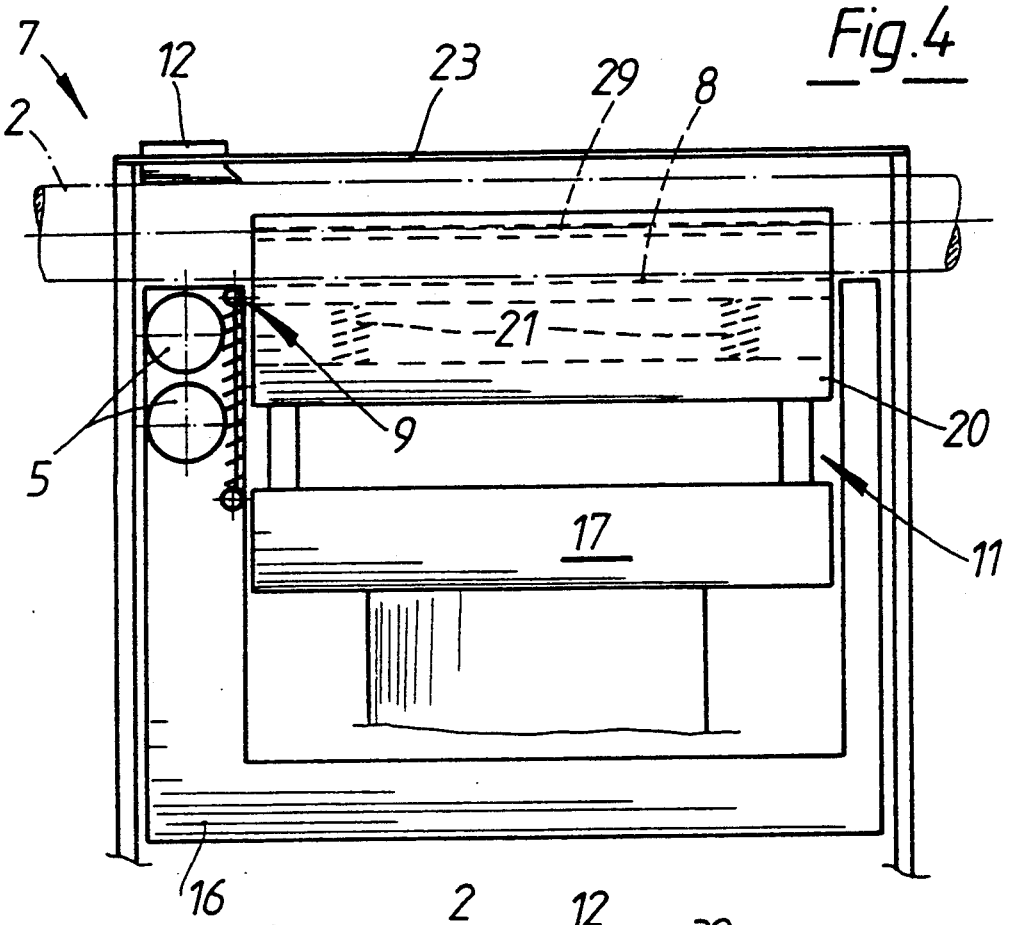
FIG. 4 is a side view corresponding to FIG. 2, showing the work head after a wire to be marked has been placed in the foil and wire receiving means.
Figure 5:
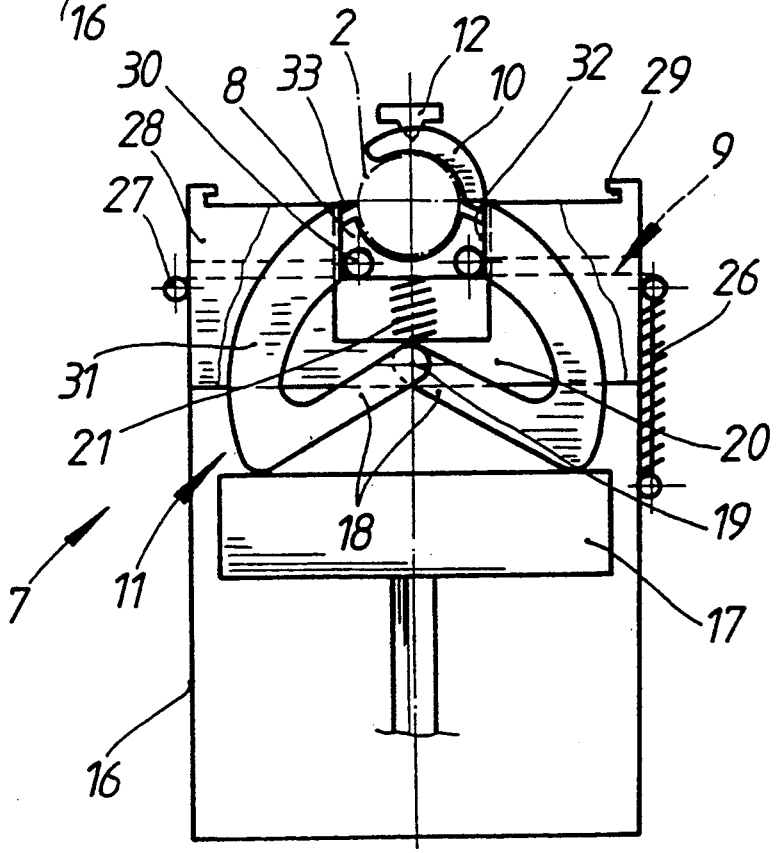
FIG. 5 is a front view of the work head of FIG. 4.

As shown in FIG. 2, the printer is followed by a work head 7 with a foil and wire receiving means 8 for the imprinted printing foil ribbon 3 and the protective foil ribbon 4 pressed against the printing foil ribbon 3 and for the wire 2 to be marked. A cutting tool 9 serves to sever an imprinted printing foil ribbon and protective foil ribbon section. The cutting tool 9 is arranged between the transport rollers 5 and the foil and wire receiving means 8. The work head 7 further includes a wire gripping member 10 for placing the wire 2 to be marked in the foil and wire receiving means 8 and on the printing foil ribbon 3 and protective foil ribbon 4 located in the foil and wire receiving means 8. In addition, the work head 7 has on both sides thereof clamping claws 11 which can be pivoted transversely of the longitudinal direction of the foil and wire receiving means 8. The clamping claws 11 ensure that the wire 2 is completely sheathed with the imprinted printing foil ribbon and protective foil ribbon section 3, 4. A cutting and welding head 12 serves to cut the projecting end 13 of the printing foil ribbon and the protective foil ribbon formed after sheathing and for welding the printing foil ribbon and protective foil ribbon edges which have been cut to the sheathing dimension, as shown in FIG. 8.

The components of the foil storage means are a roller 14 or cartridge with printing foil ribbon 3 and a roller 15 or cartridge with protective foil ribbon 4. The transport rollers 4 are constructed as needle rollers and are driven by a stepping motor, not shown. The printing head 6 is equipped with a color ribbon. The control means for the printing head 6 simultaneously controls the feed of the printing foil ribbon 3 and of the protective foil ribbon 4. The work head 7 includes a bearing housing 16 with the cutting tool 9 which is arranged stationary and transversely of the foil conveying direction. In the illustrated embodiment, the cutting tool is an electrically heated cutting wire 9 on which a tensioning spring 26 acts on one side of the housing and which is connected on the other side of the housing to ground 27.

A raisable base plate 17 is arranged in the bearing housing 16. The clamping claws 11 are supported on the base plate 17 by means of support levers 18. The support levers 18 are pivotally mounted about a longitudinal axis 19 extending in foil conveying direction and underneath the foil and wire receiving means 8. The foil and wire receiving means 8 is resiliently elastically supported in a U-shaped bearing bed 20 which is guided in the bearing housing 16 so as to be raisable. In a web portion thereof the longitudinal axis 19 for the pivotable support of the clamping claws 11 and is supported so as to be movable relative to the base plate 17. When the wire 2 is resting on the bearing housing 16 and is held by the wire grip member 10, the base plate 17 is successively raised until the clamping claws 11 have swung in and the bearing bed 20 is raisable with the foil and wire receiving means 8 with the application of tensile and compression forces, so that the foil and wire receiving means 8 is pressed against the wire 2 and is pressed downwardly with the wire 2 against the action of a spring until the clamping claws 11 engaging over the wires 2 have completely closed.

The wire gripping member 10 includes one or more holding rods with hook-like ends which are arranged on both sides of the bearing housing 16 or are structural components of the bearing housing 16. The foil and wire receiving means 8 is constructed as a support groove and is supported with the intermediate arrangement of springs 21 on the web of the U-shaped bearing bed 20.

The sides 28 of the U-shaped bearing bed 20 have lateral guide grooves 29 for the protective foil ribbon 4 which rests on the sides 28 or for the respective protective foil ribbon section with printing foil ribbon sections. In addition, the foil and wire receiving means 8 has at both ends faces thereof rollers 30 for supporting the clamping claws 11 until shortly before the clamping claws 11 reach the swung-in closed position. Accordingly, the rollers 30 prevent a premature swinging-in of the clamping claws 11 and permit movement of the clamping claws 11 only shortly before the closing procedure.

The clamping claws 11 include claw stirrups 31 with contact surfaces 32 for the rollers 30. The claw stirrups 31 are connected to the support levers 18 in the shape of a V. The clamping claws 11 further include tongue sections 33 which connect the claw stirrups 31 on both sides over the length of the foil and wire receiving means 8. In the closed state, the tongue sections 33 form a V-shaped incision 22 for the cutting and welding head 12. The cutting and welding head 12 is mounted on the bearing housing 16 so as to be displaceable in longitudinal direction of the foil ribbon above the foil and wire receiving means 8 and the cutting and welding head 12 is guided on a guide rod 23.

The application device 1 further is equipped with a computer 24 and data storage and a current supply 25, for example, a battery. The device 1 can also be connected to mains supply.

The application device according to the present invention is not only suitable for marking wires and cables. Rather, the device can also be used for other lines, such as, pipes, hoses or the like.

While a specific embodiment of the invention has been shown and described in detail to illustrate the application of the inventive principle, it will be understood that the invention may be embodied otherwise without departing from such principles.

I claim:

1. An application device for marking wires and cables, comprising a foil storage means for a printing foil ribbon and for a protective foil ribbon;

transport rollers drives in opposite directions by means of a drive motor for conveying the printing foil ribbon and the protective foil ribbon and for moving and pressing the ribbons together;

a printer including a printing head for imprinting the printing foil ribbon before the printing foil ribbon is pressed against the protective foil ribbon and including a control means for the printing head;

a work head following the printer, the work head including a wire receiving means for the imprinted printing foil ribbon and the protective foil ribbon pressed against the printing foil ribbon and for the wire to be marked;

a cutting tool for severing an imprinted printing foil ribbon and protective foil ribbon section between the transport rollers and the foil and wire receiving means;

a wire gripping means for placing the wire to be marked in the foil and wire receiving means and on the printing foil ribbon and the protective foil ribbon placed in the foil and wire receiving means;

clamping claws mounted so as to be swingable on both sides and transversely of the longitudinal direction of the foil and wire receiving means for completely sheathing the wire with the imprinted printing foil and protective foil section; and a cutting and welding head for cutting projecting excess lengths of printing foil ribbon and protective foil ribbon formed after sheathing and for welding the printing foil and protective foil edges which have been cut to sheathing dimensions.

2. The application device according to claim 1, wherein the foil storage means includes a roller with printing foil ribbon and a roller with protective foil ribbon.

3. The application device according to claim 1, wherein the transport rollers are needle rollers, further comprising a stepping motor for driving the transport rollers.

4. The application device according to claim 1, wherein the printing head includes a color ribbon.

5. The application device according to claim 1, wherein the control means for the printing head includes means for controlling the feed of the printing foil ribbon and the protective foil ribbon.

6. The application device according to claim 1, wherein the work head includes a bearing housing with the cutting tool, the cutting tool being mounted stationary and transversely of the foil conveying direction.

7. The application device according to claim 1, wherein the cutting tool is a knife.

8. The application device according to claim 6, wherein the cutting tool is an electrically heated cutting wire, the application device further comprising a tensioning spring for acting on the cutting wire on one side of the housing, wherein the cutting wire is connected for grounding to another side of the housing.

9. The application device according to claim 6, comprising a raisable base plate mounted in the bearing housing, the clamping claws being supported on the base plate by means of support levers, the support levers being pivotally mounted about a longitudinal axis extending in foil conveying direction and underneath the foil and wire receiving means, the foil and wire receiving means being resiliently elastically supported in a U-shaped bearing bed, the bearing bed being raisably guided in the bearing housing, the U-shaped bearing bed having sides and a web portion connecting the sides, the bearing bed including in the web portion thereof the longitudinal axis for the pivotable support of the clamping claws and being supported so as to be movable relative to the base plate, wherein, when the wire is resting on the web portion of the bearing bed and is held by the wire gripping means, the base plate being successively raisable until the clamping claws are swung in and the bearing bed being raisable with the foil and wire receiving means with the application of tensile and compression forces, such that the foil and wire receiving means is pressed against the wire and is pressed downwardly with the wire against the action of a spring until the clamping claws engaging over the wire have completely closed.

10. The application device according to claim 9, wherein the sides of the bearing bed have lateral guide grooves for the protective foil ribbon which rests on the sides of the bearing bed.

11. The application device according to claim 9, wherein the wire gripping means includes at least one support rod with a hook-like rod end, the support rod being a component of the bearing housing.

12. The application device according to claim 9, wherein the wire gripping means includes a plurality of support rods having hook-like rod ends, the support rods being arranged on both sides of the bearing housing.

13. The application device according to claim 9, wherein the foil and wire receiving means is a support groove, the foil and wire receiving means being supported by the web portion of the bearing bed, springs being arranged between the web portion and the foil and wire receiving means.

14. The application device according to claim 9, wherein the foil and receiving means has two ends, the ends having mounted thereon rollers for supporting the clamping claws until shortly before the clamping claws reach the swung-in closed position.

15. The application device according to claim 14, wherein the clamping claws include claw stirrups with contact surfaces for the rollers, the claw stirrups being connected to the support levers to form the shape of a V, the clamping claws further including tongue sections for connecting the claw stirrups over the length of the foil and wire receiving means, the tongue section forming in a closed state thereof a V-shaped incision.

16. The application device according to claim 6, wherein the cutting and welding head is mounted on the bearing housing so as to be displaceable in longitudinal direction of the foil ribbons above the foil and wire receiving means, and wherein the cutting and welding edge is guided on a guide rod.

17. The application device according to claim 1, comprising a computer and data storage and having an independent current supply.

18. The application device according to claim 1, comprising a computer and data storage and being connectable to mains supply.

* * * * *